US011472628B2

(12) United States Patent
Lang et al.

(10) Patent No.: US 11,472,628 B2
(45) Date of Patent: Oct. 18, 2022

(54) TUMBLER WITH MANEUVERABLE STRAW

(71) Applicant: Galina Lang, San Francisco, CA (US)

(72) Inventors: Galina Lang, San Francisco, CA (US); Shuibing Zhou, Ningbo (CN)

(73) Assignee: Galina Lang, San Francisco, CA (US)

( * ) Notice: Subject to any disclaimer, the term of this patent is extended or adjusted under 35 U.S.C. 154(b) by 61 days.

(21) Appl. No.: 17/166,409

(22) Filed: Feb. 3, 2021

(65) Prior Publication Data

US 2021/0323757 A1 Oct. 21, 2021

Related U.S. Application Data

(60) Provisional application No. 63/026,530, filed on May 18, 2020.

(30) Foreign Application Priority Data

Apr. 20, 2020 (CN) ..... 202020587188.5

(51) Int. Cl.
*A47G 21/18* (2006.01)
*B65D 85/72* (2006.01)
(Continued)

(52) U.S. Cl.
CPC ..... *B65D 85/72* (2013.01); *A47G 19/2266* (2013.01); *A47G 21/18* (2013.01);
(Continued)

(58) Field of Classification Search
CPC ..... B65D 85/72; B65D 47/06; B65D 77/28; B65D 2251/0025; B65D 77/283; B65D 5/66; B65D 5/64; B65D 47/08; B65D 47/0838; B65D 47/0857; B65D 47/088; B65D 2251/1016; B65D 2251/1058; A47G 19/2266; A47G 21/18; B54D 2543/00046
See application file for complete search history.

(56) References Cited

U.S. PATENT DOCUMENTS 4,485,963 A * 12/1984 Panicci ..... A47G 19/2266 222/536
2019/0290037 A1* 9/2019 Wiesman ..... A47G 21/186
(Continued)

FOREIGN PATENT DOCUMENTS

EP 2927152 A1 * 10/2015 ..... A47G 19/2272
EP 3214013 A1 * 9/2017 ..... A47G 19/2205

*Primary Examiner* — Don M Anderson
*Assistant Examiner* — Sydney Grace Streib

(57) ABSTRACT

A tumbler with maneuverable straw is an apparatus that facilitates the consumption of small edible additives of a beverage. The apparatus includes a straw assembly, a lid, and a tumbler. The straw assembly includes a mouthpiece, a straw, and a main channel. The straw assembly delivers the beverage and small edible additives contained within the tumbler to the mouth of the user. The mouthpiece serves as a mount for the lips of the user and allows the user to maneuver the straw within the tumbler. The lid covers an open end of the tumbler and mounts the straw assembly onto the tumbler. The lid seals the open end of the tumbler, preventing any leakage, and receives the straw assembly. The tumbler contains a beverage and any small edible additives such as tapioca balls. The apparatus further includes a friction inducing base that protects a closed end of the tumbler.

12 Claims, 7 Drawing Sheets

(51) Int. Cl.

| | |
|---|---|
| ***A47G 19/22*** | (2006.01) |
| ***B65D 47/06*** | (2006.01) |
| ***B65D 77/28*** | (2006.01) |

(52) U.S. Cl.
CPC ..... *B65D 47/06* (2013.01); *B65D 77/28* (2013.01); *B65D 2251/0025* (2013.01)

(56) References Cited

U.S. PATENT DOCUMENTS

| | | | | |
|---|---|---|---|---|
| 2020/0085217 | A1* | 3/2020 | Heiberger | B65D 51/24 |
| 2020/0138212 | A1* | 5/2020 | Nishijima | A47G 21/188 |
| 2021/0307547 | A1* | 10/2021 | Perkins | A47G 19/2266 |

* cited by examiner

TUMBLER WITH MANEUVERABLE STRAW

FIELD OF THE INVENTION

The present invention generally relates to drinkware. More specifically, the present invention is a tumbler with maneuverable straw. The tumbler with maneuverable straw suctions small edible additives within the tumbler while preserving a spill-proof and leak-proof seal throughout use.

BACKGROUND OF THE INVENTION

Popular drinks such as milk teas, coffees, and colas have been modified with the addition of various ingredients such as balled taro, tapioca pearls, fruit jellies, and a multitude of other ingredients as may suit personal tastes and preferences. Recombination of various additives and fluid bases to mix-and-match flavors and textures is an established practice in the industry and partaken with enthusiasm by customers of venues serving such specialty drinks. The inclusion of these solid additives has required the use of oversized straws or other unconventional utensils to effectively consume, given that regular straws cannot accommodate the solids. Aside from disposable single-use cups and straws previous innovators have produced examples of such oversized straws mounted within a hard-shelled travel bottle enabling a user to consume said mixed drinks on-the-go. However, the examples of such travel bottles available generally fail to provide a means of effectively angling a straw to pick up the solids from the bottom of a bottle, often featuring a straw fixed to a single gimbal point within a lid, or a single perforation that does not effectively seal the interior of the travel container around the straw.

The present invention aims to provide an improvement over conventional travel containers, primarily concerning the addition of a flexible mounting arrangement between a straw and a lid. Most critically, the straw may be translated laterally within the tumbler while maintaining a manifold reservoir within the tumbler. This arrangement will enable users to more effectively angle the straw to capture solid additives resting at the bottom of the cup compared to conventional travel containers.

DETAIL DESCRIPTIONS OF THE INVENTION

Figure 1:
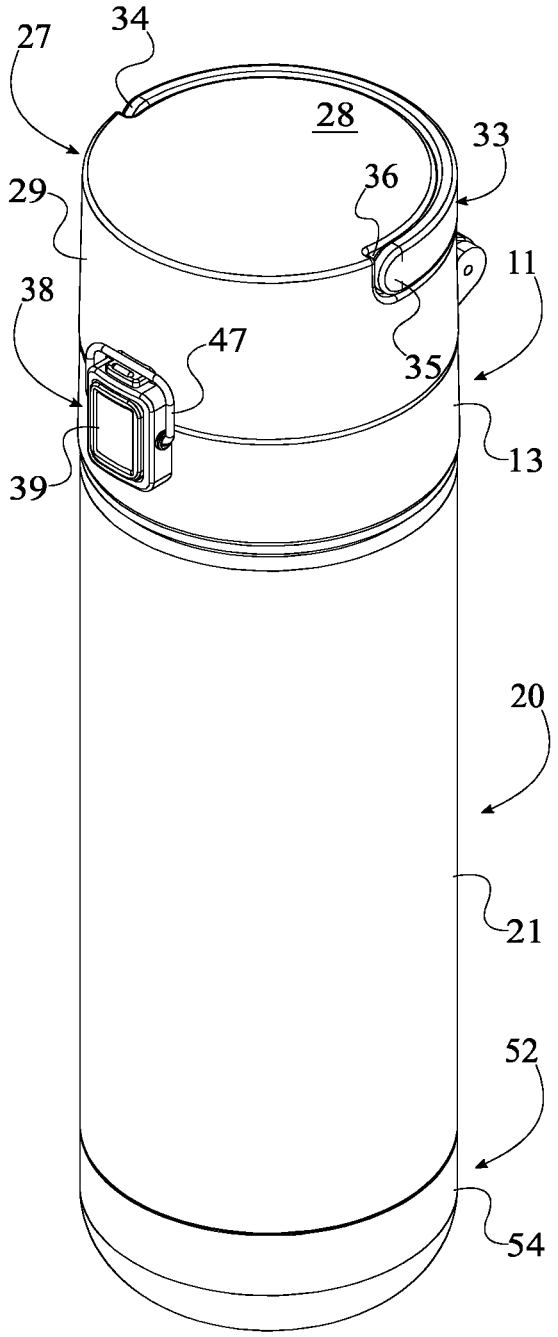
FIG. 1 is a perspective view of the present invention in a locked configuration.

All illustrations of the drawings are for the purpose of describing selected versions of the present invention and are not intended to limit the scope of the present invention.

The present invention is a tumbler with maneuverable straw. The present invention allows a maneuverable straw to be positioned over small edible additives of a beverage while preserving the seal of the tumbler. The present invention is separable and reusable. The present invention may be used with cold or warm beverages. More specifically, the present invention facilitates the consumption of bubble tea beverages. In order for the present invention to provide a sealed container for beverages such as bubble tea and a maneuverable straw, the present invention comprises a straw assembly 1, a lid 11, and a tumbler 20, seen in FIG. 1, FIG. 2, FIG. 3, and FIG. 4. The straw assembly 1 delivers the beverage and small edible additives of the beverage to the mouth of a user with minimal suctioning by the mouth of the user. The straw assembly 1 comprises a mouthpiece 2, a straw 5, and a main channel 8. The mouthpiece 2 is the accessible portion of the straw assembly 1 that a user mounts his or her lips. The mouthpiece 2 also controls the orientation of the straw 5. More specifically, the mouthpiece 2 comprises a cylindrical portion 3 and a hemispherical base portion 4. The cylindrical portion 3 is the gripping portion of the mouthpiece 2 for the lips of the user, and the hemispherical base portion 4 receives the straw 5 and allows the cylindrical portion 3 to be pivoted while connected with the lid 11, as well as the straw 5. In the preferred embodiment of the present invention, the mouthpiece 2 and the straw 5 comprise a width that accommodates edible additives with the girth of tapioca balls. The straw 5 delivers the beverage and edible additives from within the tumbler 20 to the mouthpiece 2. The main channel 8 is the continuous path from the straw 5 and the mouthpiece 2 for the beverage and the edible additives to traverse out of the tumbler 20 and through the lid 11.

Figure 2:
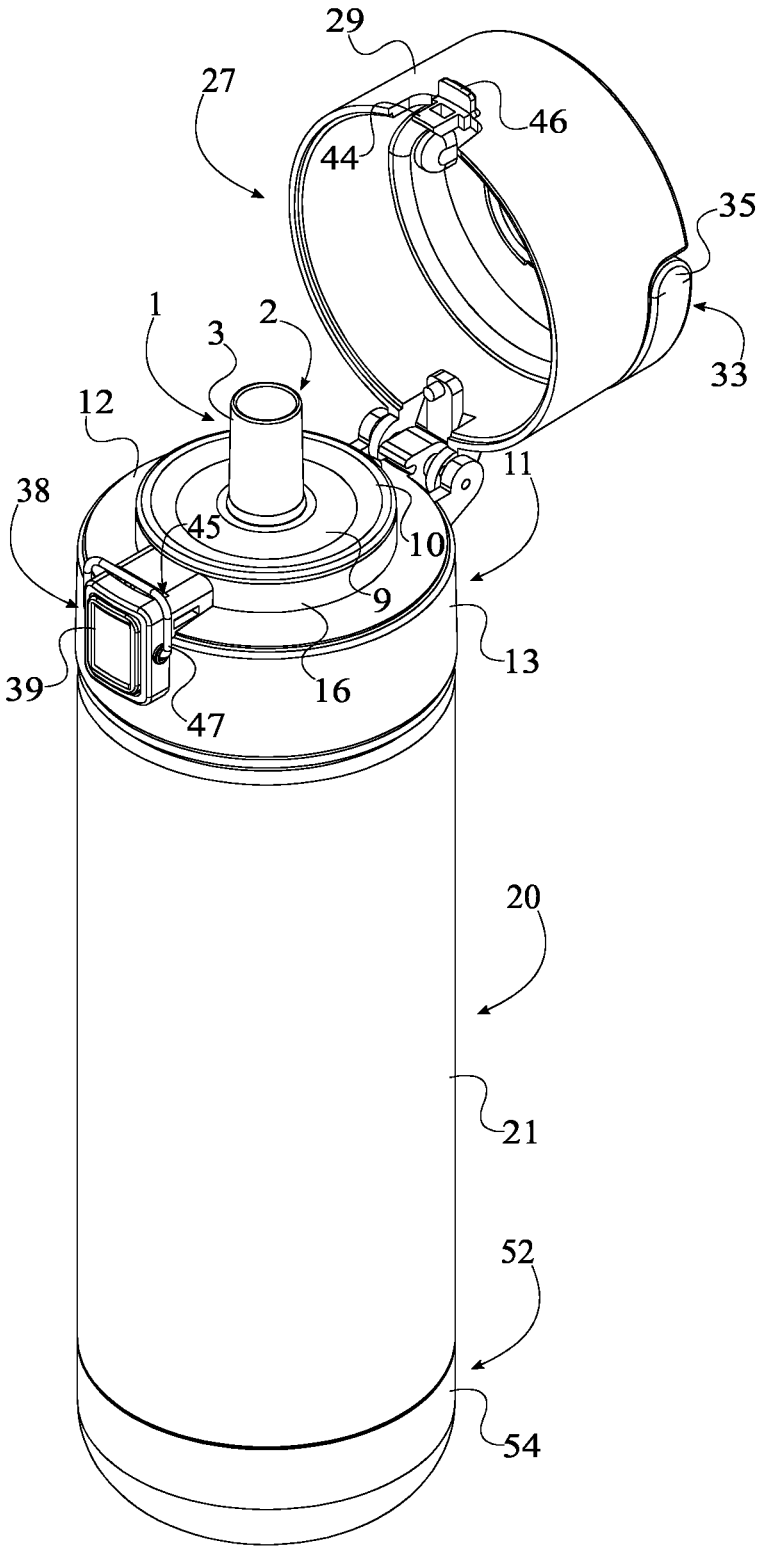
FIG. 2 is a perspective view of the present invention in an opened configuration.
Figure 4:
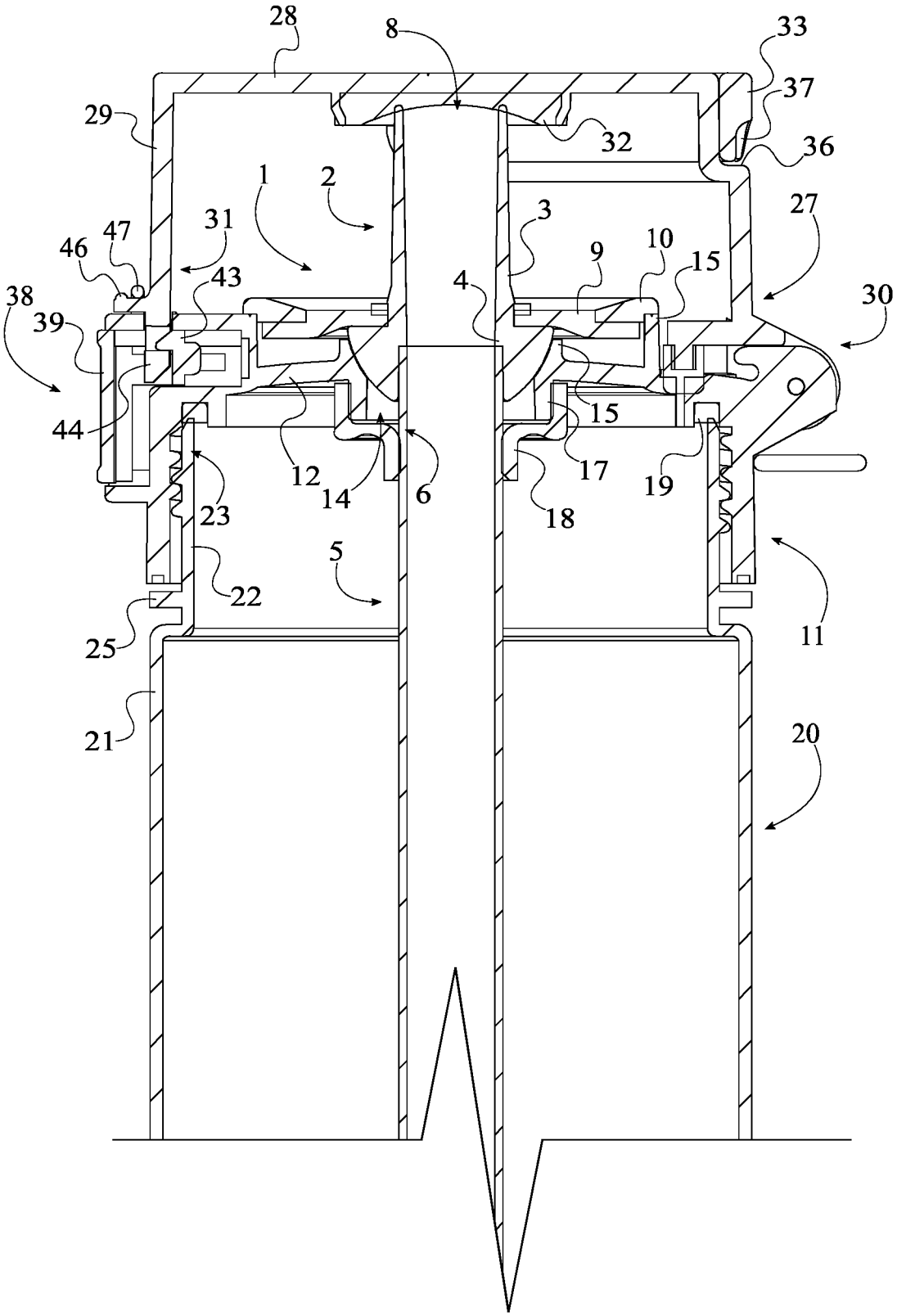
FIG. 4 is a cross-section view of a protective cap, a lid, and a straw assembly with that of an open end of tumbler of FIG. 3 along line 4-4 for the present invention.

In order for the lid 11 to seal the tumbler 20 while providing a deformable mount for the straw assembly 1, the lid 11 comprises a first base plate 12, a first lateral wall 13, a first slot 14, and an inner ring 15, seen in FIG. 2 and FIG. 4. The first base plate 12 and the first lateral wall 13, together, cover and seal the tumbler 20. The first slot 14 provides access for the straw 5 through the lid 11, as well as space for the mouthpiece 2 to connect with the straw 5 through the lid 11. In order for the tumbler 20 to contain and house a beverage and small edible additives, the tumbler 20 comprises a cylindrical body 21, a lip 22, an open end 23, and a closed end 24. The cylindrical body 21 contains the beverage and the small edible additives. The lip 22 provides a mount for the lid 11. The open end 23 provides access into the cylindrical body 21 so that the tumbler 20 is refillable, and the closed end 24 upholds the beverage and the small edible items within the cylindrical body 21.

Figure 5:
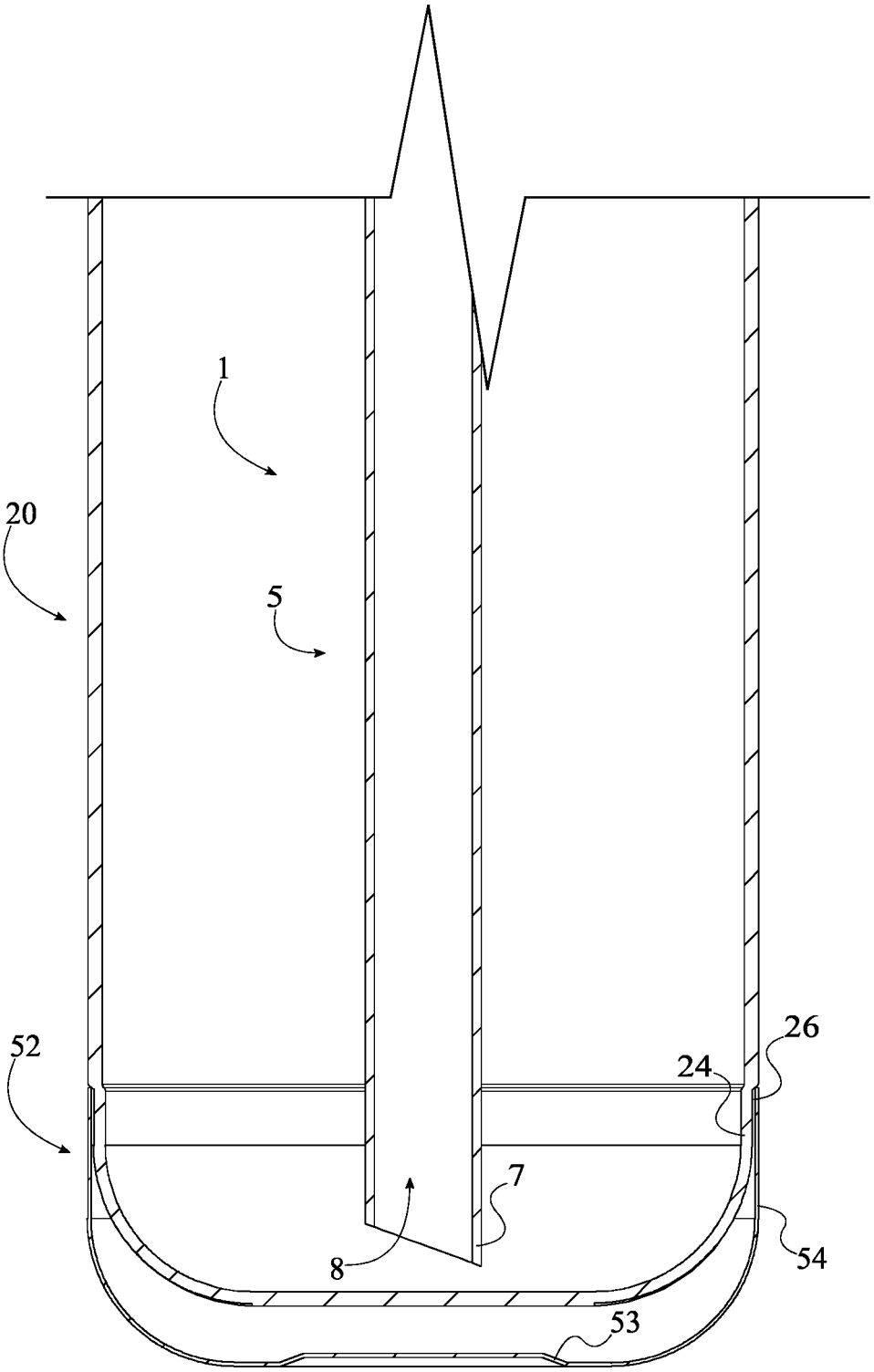
FIG. 5 is a cross-section view of a friction-inducing base and the straw assembly with that of a closed end of the tumbler of FIG. 3 along line 4-4 for the present invention.

The overall arrangement of the aforementioned components allows the straw assembly 1 to be maneuvered and directed towards specific small food additives across the bottom of the tumbler 20. The tumbler 20 is filled with a beverage with small edible additives as the open end 23 is positioned opposite the closed end 24 about the cylindrical body 21, seen in FIG. 4 and FIG. 5. The lip 22 is positioned adjacent with the open end 23 and is fixed around the open end 23 so that the lid 11 may seal the open end 23 of the tumbler 20. The tumbler 20 contains the beverage with the small edible additives as the first lateral wall 13 is positioned adjacent with the first base plate 12 and is perimetrically fixed around the first base plate 12. The lid 11 provides a sufficient seal with the tumbler 20 as the first lateral wall 13 is threadedly engaged with the lip 22. In order for the straw 5 to traverse through the lid 11 while preserving the structural integrity of the lid 11, the first slot 14 traverses through the first base plate 12. The inner ring 15 is fixed with the first base plate 12 and is positioned around the first slot 14, thereby positioning the mouthpiece 2, and consequently the straw 5 with the lid 11. The mouthpiece 2 and the straw 5 are positioned within the first slot 14. The mouthpiece 2 is externally positioned with the tumbler 20 so that the user may maneuver the mouthpiece 2 with his or her lips and or fingers. More specifically, the cylindrical portion 3 is fixed adjacent with the hemispherical base portion 4, and a fixed end 6 of the straw 5 is positioned opposite a free end 7 of the straw 5. The fixed end 6 connects the straw 5 with the hemispherical base portion 4, and the free end 7 is positioned onto or near the small edible additives within the tumbler 20. In order to connect the straw 5 with the mouthpiece 2, the fixed end 6 is removably engaged into the hemispherical base portion 4. Both the beverage and the edible additives are able to leave the tumbler 20 as the main channel 8 traverses through the cylindrical portion 3, the hemispherical base portion 4, and the straw 5. The free end 7 of the straw 5 may be directed to a specific edible additive within the tumbler 20 as the hemispherical base portion 4 is rotatably mounted within the inner ring 15.

The mouthpiece 2 is shielded and covered as the present invention further comprises a protective cap 27 and a locking mechanism 38, seen in FIG. 1, FIG. 2, FIG. 3, FIG. 4, FIG. 6, and FIG. 7. The protective cap 27 surrounds the mouthpiece 2, and the locking mechanism 38 locks and unlocks the protective cap 27 with the lid 11. The protective cap 27 comprises a second base plate 28, a second lateral wall 29, a hinged end 30, and a locking end 31. The second base plate 28 and the second lateral wall 29, together, enclose the mouthpiece 2. The hinged end 30 pivots about the lid 11, and the locking end 31 connects and disconnects to the lid 11 with the locking mechanism 38. The mouthpiece 2 is positioned within the protective cap 27 while in a locked configuration as the second lateral wall 29 is positioned adjacent with the second base plate 28 and is perimetrically fixed with the second base plate 28. The hinged end 30 is positioned opposite the locking end 31 about the second lateral wall 29, allowing the protective cap 27 to flip 22 open and flip 22 closed. The first base plate 12 is positioned adjacent with the second lateral wall 29, opposite the second base plate 28, thereby offsetting the second base plate 28 with the lid 11. In order to access the mouthpiece 2 while in an opened configuration, the second lateral wall 29 is hingedly coupled with the first base plate 12. The lid 11 is operatively coupled with the protective cap 27, wherein the locking mechanism 38 locks and unlocks the protective cap 27 with the lid 11, securing the connection between the protective cap 27 and the lid 11 while in the locked configuration.

In order to release the protective cap 27 with the lid 11 for the opened configuration, the locking mechanism 38 comprises a button 39, a spring 40, a lever 43, a first tab 44, and a second slot 45, also seen in FIG. 1, FIG. 2, FIG. 3, FIG. 4, FIG. 6, and FIG. 7. The button 39 provides a user manual control over the locking mechanism 38. The spring 40 returns the lever 43 to an extended position once engaged by the button 39. The lever 43 hooks onto the first tab 44, and consequently the protective cap 27, while in the locked configuration. The second slot 45 provides space within the lid 11 to receive the first tab 44. The protective cap 27 freely flips open and closes as the button 39, the spring 40, the lever 43, and the first tab 44 are positioned adjacent with the locking end 31, opposite the second base plate 28. In order to access the button 39, the button 39 is externally mounted into the first lateral wall 13. The spring 40, the lever 43, and the second slot 45 are internally integrated into the first lateral wall 13, thereby preserving the superimposed arrangement of the second lateral wall 29 of the protective cap 27 around the first base plate 12 of the lid 11. The protective cap 27 securely connects with the lid 11 as the first tab 44 is fixed with the second lateral wall 29 and is oriented coplanar with the second lateral wall 29. In order to conceal and protect the engagement between the spring 40 and the lever 43, the spring 40 is mounted within the first base plate 12. The lever 43 is positioned offset with the button 39 and is connected with the button 39. Moreover, the lever 43 is slidably engaged within the first base plate 12 so that the engagement of the button 39 by the user simultaneously engages the lever 43. In order for the lever 43, and consequently the button 39 to return to the extended position, the lever 43 is positioned in between the spring 40 and the button 39. Moreover, a fixed end 41 of the spring 40 is fixed with the second base plate 28, and a free end 42 of the spring 40 is positioned adjacent with the lever 43. The fixed end 41 remains fixed within the first base plate 12 as the free end 42 translates between the extended position and a retracted position, wherein the button 39 is pressed, the lever 43 disengages with the first tab 44, and the spring 40 contracts. In order to preserve the structural integrity of the lid 11 while being able to readily receive the first tab 44, the second slot 45 traverses into the first base plate 12 and is positioned in between the lever 43 and the button 39. This arrangement positions the first tab 44 adjacent the lever 43 so that the lever 43 may hook into the first tab 44. The protective cap 27 is locked and unlocked with the lid 11 as the lever 43 is operatively coupled with the first tab 44, wherein the button 39 hooks and unhooks the lever 43 with the first tab 44.

In order to further secure the connection between the protective cap 27 and the lid 11 while in the locked configuration, the locking mechanism 38 further comprises a second tab 46 and a latch 47, seen in FIG. 1, FIG. 2, FIG. 3, FIG. 4 and FIG. 6. The second tab 46 allows the latch 47 to catch onto the protective cap 27. More specifically, the second tab 46 and the latch 47 serve as a supplementary fastener that reinforces the connection between the protective cap 27 and the lid 11 in the event the button 39 is accidentally engaged. Similar with the button 39, the spring 40, the lever 43, the first tab 44, and the second slot 45, the second tab 46 and the latch 47 are positioned adjacent with the locking end 31, opposite the second base plate 28. In order for a user to access the latch 47, the latch 47 is externally positioned with the first lateral wall 13. More specifically, a fixed end 50 of the latch 47 is hingedly connected with the first lateral wall 13, and a free end 51 of the latch 47 is positioned opposite the fixed end 50 about the latch 47. In the preferred embodiment of the present invention, the latch 47 is positioned around the button 39, and the fixed end 50 is rotatably mounted with the button 39. Moreover, the latch 47 is positioned adjacent with the first lateral wall 13. In order for the latch 47 to connect the protective cap 27 with the lid 11, the second tab 46 is externally fixed with the second lateral wall 29 and is oriented perpendicular with the second lateral wall 29. The free end 51 of the latch 47 is engaged with the second tab 46, thereby reinforcing the locked configuration of the protective cap 27 with the lid 11.

The protective cap 27 not only encloses the mouthpiece 2 but seals the mouthpiece 2 as the protective cap 27 further comprises a mouthpiece-receiving gasket 32, seen in FIG. 4. The mouthpiece-receiving gasket 32 seals the main channel 8 while the protective cap 27 is in the locked configuration.

In order for the mouthpiece-receiving gasket 32 to press against the mouthpiece 2, the mouthpiece-receiving gasket 32 is mounted onto the second base plate 28 and is positioned within the second lateral wall 29. The mouthpiece 2 is positioned adjacent with the mouthpiece-receiving gasket 32 while in the locked configuration preserving the leakproof seal of the present invention.

The present invention is easily transported and stored as the protective cap 27 further comprises a handle 33, a handle bed 36, and a notch 37, seen in FIG. 1, FIG. 2, FIG. 3, FIG. 4, and FIG. 6. The handle 33 allows a user to carry the present invention without having to grasp the tumbler 20. The handle bed 36 provides a flushed arrangement between the handle 33 and the protective cap 27 for a compact structure. The notch 37 facilitates the removal of the handle 33 from the handle bed 36. In order for the handle 33 to be positioned around the protective cap 27, a first end 34 of the handle 33 is positioned opposite a second end 35 of the handle 33 about the handle 33. The handle 33 is flush with the proactive cap while not in use as the handle bed 36 is externally integrated into the second base plate 28. While not in use, the handle 33 traverses across the handle bed 36. The handle 33 rotates into and out of the handle bed 36 as the first end 34 and the second end 35 are hingedly connected into the handle bed 36. The handle 33 is easily lifted from within the handle bed 36 as the notch 37 is centrally positioned along the handle 33 and traverses into the handle 33.

The leakproof seal of the present invention is further maintained as the straw assembly 1 comprises an inner seal 9 and an outer seal 10, seen in FIG. 2 and FIG. 4. The inner seal 9 reinforces the position of the mouthpiece 2 with the lid 11 throughout the pivoting of the mouthpiece 2 by a user. The outer seal 10 further ensures the beverage within the tumbler 20 does not leak through the first slot 14 and past the hemispherical base portion 4 while maneuvering the straw 5. In order to secure the inner seal 9 and the outer seal 10, the lid 11 further comprises an outer ring 16. The lid 11 also comprises a flange 17 and a straw-receiving gasket 18 to reinforce the leakproof seal between the straw 5 and the lid 11. The flange 17 provides a mountable surface for the straw-receiving gasket 18. The straw-receiving gasket 18 reinforces the containment of the beverage between the tumbler 20 and the lid 11. More specifically, the straw-receiving gasket 18 is the first defense against the beverage leaking through the first slot 14 while the mouthpiece 2 maneuvers the straw 5. The straw-receiving gasket 18 also secures the position of the straw 5 within the tumbler 20, and consequently reinforces the connection between the hemispherical base portion 4 and the straw 5. In order to reinforce the leakproof seal of the present invention above the lid 11, the outer ring 16 is fixed with the first base plate 12 and is positioned around the inner ring 15. In order to reinforce the leakproof seal of the present invention within the tumbler 20, the flange 17 is fixed with the first base plate 12, opposite both the inner ring 15 and the outer ring 16. The flange 17 is positioned around the first slot 14, preserving the space for the connection between the straw 5 with the hemispherical base portion 4. The inner seal 9 is positioned in between the cylindrical portion 3 and the hemispherical base portion 4. The inner seal 9 is hermetically sealed around the hemispherical base portion 4. This arrangement provides a deformable and flexible connection between the mouthpiece 2 and the lid 11 while preserving the leakproof seal of the present invention. Furthermore, the outer seal 10 traverses from the inner seal 9 to the outer ring 16 and is hermetically sealed around both the inner seal 9 and the outer ring 16, thereby containing any possible leakage from the first slot 14 within the outer ring 16, the outer seal 10 and the inner seal 9. The straw-receiving gasket 18 provides a seal within the tumbler 20 around the first slot 14 as the straw-receiving gasket 18 is positioned adjacent with the flange 17 and is mounted around the flange 17. The straw 5 is hermetically sealed with the straw-receiving gasket 18, thereby reinforcing connection between the straw 5 with the hemispherical base portion 4 and limiting any leakage through the first slot 14.

Figure 3:
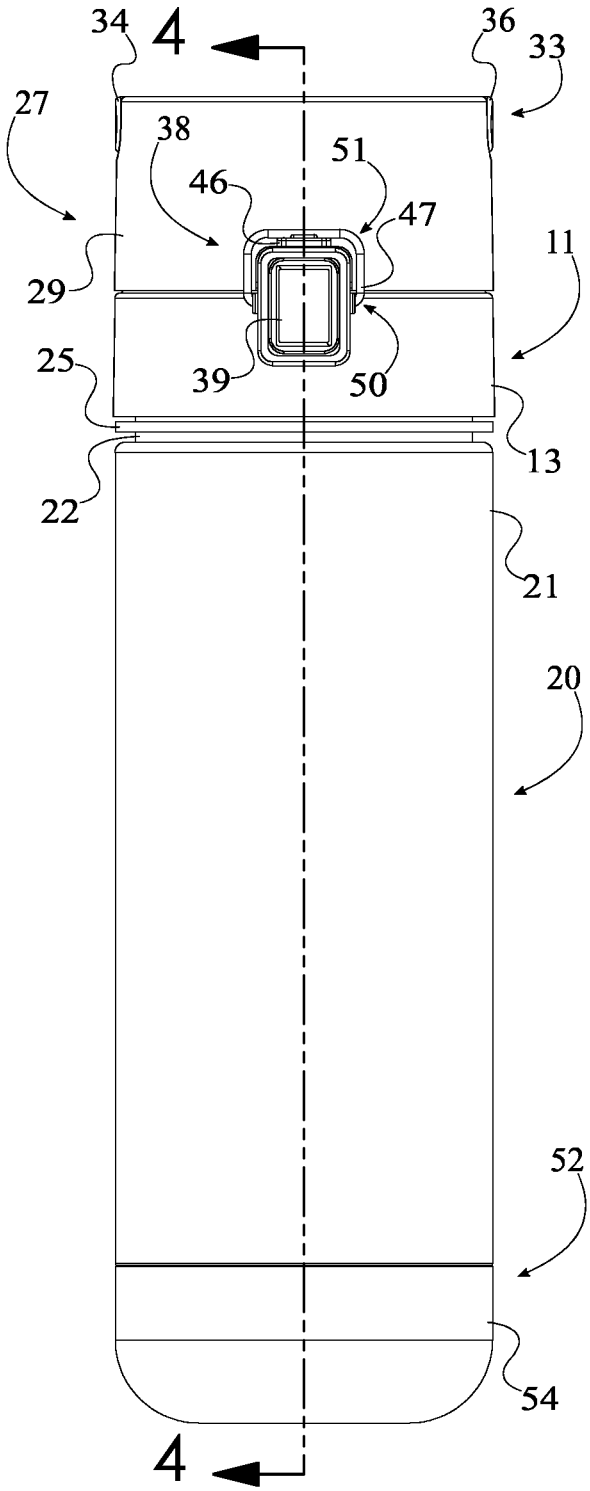
FIG. 3 is a front side view of the present invention in the locked configuration.
Figure 6:
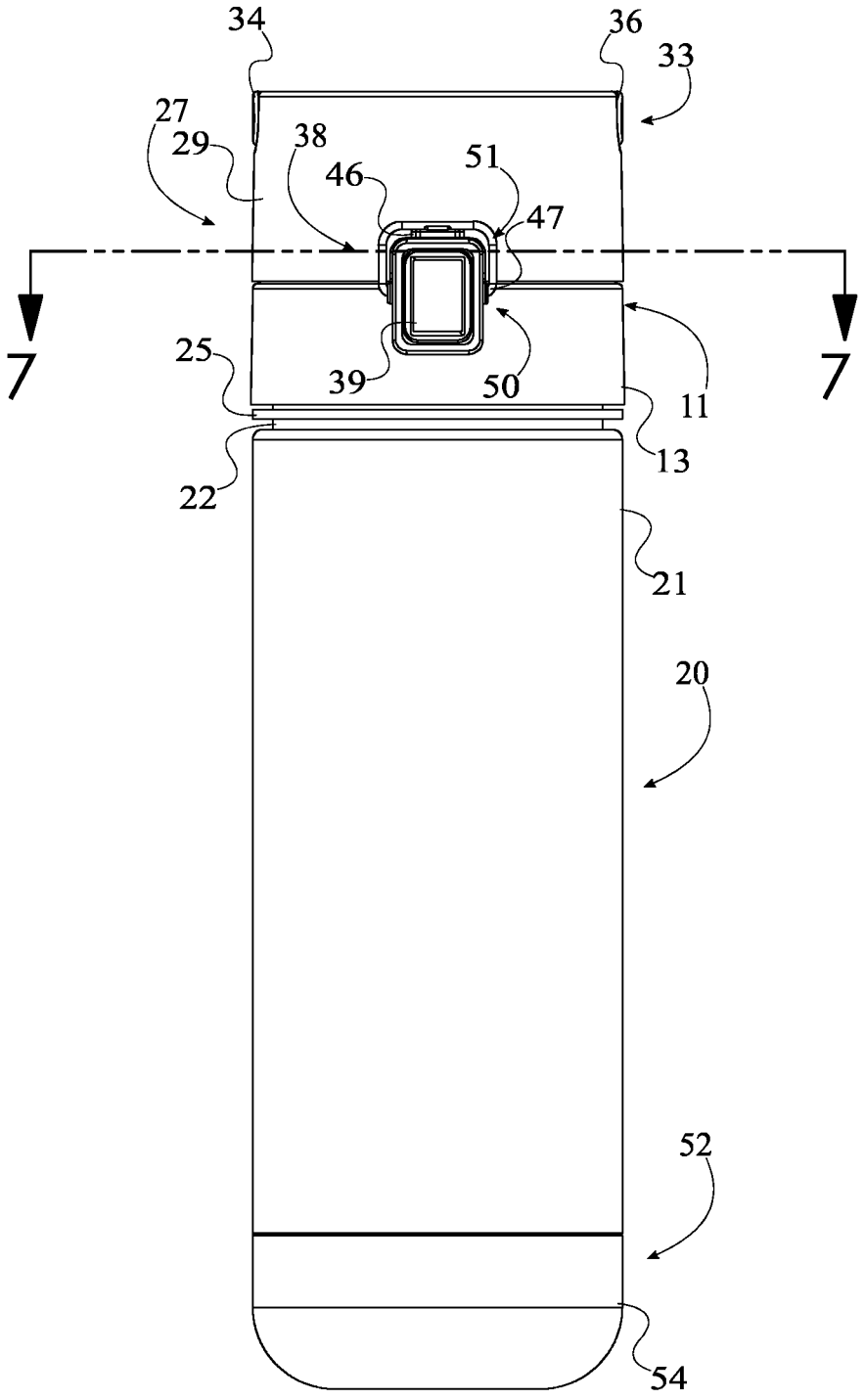
FIG. 6 is a front side view of the present invention in the locked configuration.
Figure 7:
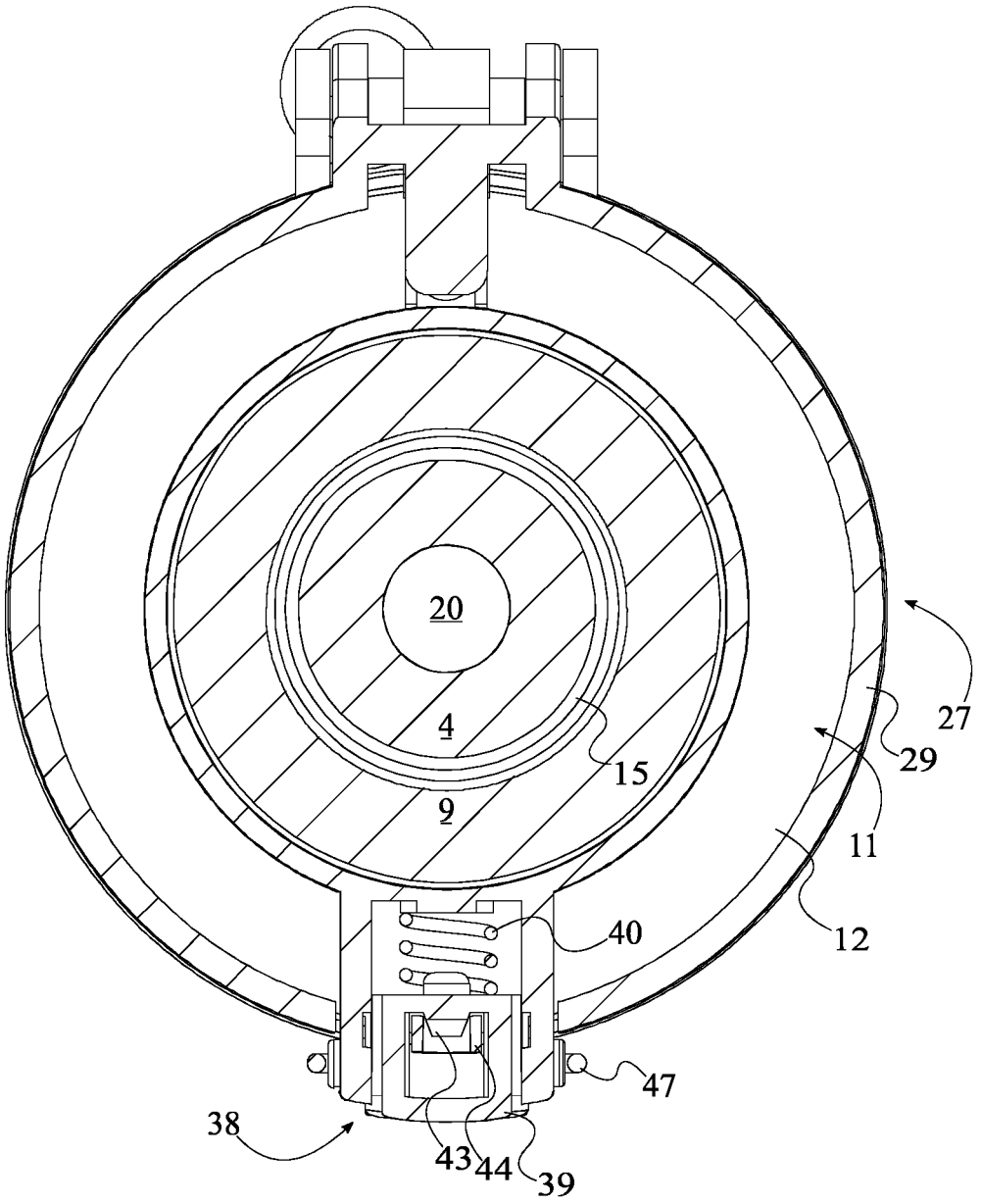
FIG. 7 is a cross-section view of a locking mechanism with the protective cap and the lid of FIG. 6 along line 7-7 for the present invention.

The threaded engagement between the lid 11 and the tumbler 20 is preserved as the tumbler 20 further comprises a ledge 25, seen in FIG. 3, FIG. 4, and FIG. 6. The ledge 25 serves as a stopper for the lid 11. As the lid 11 surrounds the lip 22 of the tumbler 20, the ledge 25 is externally positioned around the lip 22 and is positioned adjacent with the cylindrical body 21. This arrangement allows the lid 11 to fully extend across the lip 22. The ledge 25 serves as a stopper for the lid 11 as the ledge 25 is fixed with the lip 22. While the lid 11 is engaged with the tumbler 20, the ledge 25 is positioned adjacent with the first lateral wall 13, opposite the first base plate 12.

In order to further seal the present invention along the connection between the tumbler 20 and the lid 11, the lid 11 further comprises a rim 55 and a lip-receiving gasket 19, seen in FIG. 4. The rim 55 positions the lip-receiving gasket 19, and the lip-receiving gasket 19 presses against the lip 22 of the tumbler 20. In order for the lip-receiving gasket 19 to press against the lip 22, the rim 55 is fixed with the first base plate 12 and is positioned opposite the inner ring 15 about the first base plate 12. Moreover, the rim 55 is also positioned offset with the first lateral wall 13 so that the lip-receiving gasket 19 is positioned across the lip 22. The lip-receiving gasket 19 seals the lid 11 with the tumbler 20 while the lid 11 covers the tumbler 20 as the lip-receiving gasket 19 is positioned in between the first lateral wall 13 and the rim 55. Furthermore, the lip-receiving gasket 19 remains attached with the lid 11 while the lid 11 is separated from the tumbler 20 as the lip-receiving gasket 19 is mounted with the first base plate 12.

The structural integrity of the tumbler 20 is protected as the present invention further comprises a friction-inducing base 52, seen in FIG. 1, FIG. 2, FIG. 3, FIG. 5, and FIG. 6. The friction-inducing base 52 absorbs any shock against the closed end 24 of the tumbler 20 and secures the desired position of the tumbler 20 across a surface. The aesthetic and compact structure of the present invention is preserved with the friction-inducing base 52 as the tumbler 20 further comprises a base-receiving groove 26. The base-receiving groove 26 allows the friction-inducing base 52 to be flushed with the cylindrical body 21. The friction-inducing base 52 comprises a third base plate 53 and a third lateral wall 54 in order for the friction-inducing base 52 to preserve the overall structure of the tumbler 20. In order to surround the closed end 24 of the tumbler 20, the third lateral wall 54 is positioned adjacent with the third base plate 53 and is perimetrically fixed with the third base plate 53. The base-receiving groove 26 is positioned around the closed end 24 of the tumbler 20 and is externally integrated into the cylindrical body 21. This positions the third lateral wall 54 in a flushed arrangement with the cylindrical body 21. The third lateral wall 54 is frictionally engaged around the base-receiving groove 26. Moreover, the third lateral wall 54 is positioned offset with the closed end 24 of the cylindrical body 21, thereby absorbing any shocks towards the closed end 24 of the tumbler 20 while preventing the closed end 24 from being directly impacted by any shock. In the preferred embodiment of the present invention, the closed end 24 of the cylindrical body 21 is curved providing a more stable and structurally sound tumbler 20. Furthermore, the curvature of the cylindrical body 21 directs small edible additives towards the free end 7 of the straw 5, thereby facilitating the suctioning of small edible additives across the closed end 24 of the cylindrical body 21.

Although the invention has been explained in relation to its preferred embodiment, it is to be understood that many other possible modifications and variations can be made without departing from the spirit and scope of the invention as hereinafter claimed.

What is claimed is:

1. A tumbler with maneuverable straw comprises:

a straw assembly;

a lid;

a tumbler;

the straw assembly comprises a mouthpiece, a straw, and a main channel;

the lid comprises a first base plate, a first lateral wall, a first slot, and an inner ring;

the tumbler comprises a cylindrical body, a lip, an open end, and a closed end;

the mouthpiece comprises a cylindrical portion and a hemispherical base portion;

the open end being positioned opposite the closed end about the cylindrical body;

the lip being positioned adjacent with the open end;

the lip being perimetrically fixed around the open end;

the first lateral wall being positioned adjacent with the first base plate;

the first lateral wall being perimetrically fixed around the first base plate;

the first lateral wall being threadedly engaged with the lip;

the first slot traversing through the first base plate;

the inner ring being fixed with the first base plate;

the inner ring being positioned around the first slot;

the mouthpiece and the straw being positioned within the first slot;

the mouthpiece being externally positioned with the tumbler;

the cylindrical portion being fixed adjacent with the hemispherical base portion;

a fixed end of the straw being positioned opposite a free end of the straw;

the fixed end being removably engaged into the hemispherical base portion;

the main channel traversing through the cylindrical portion, the hemispherical base portion, and the straw; and, the hemispherical base portion being rotatably mounted within the inner ring.

2. The tumbler with maneuverable straw as claimed in claim 1 comprises:

a protective cap;

a locking mechanism;

the protective cap comprises a second base plate, a second lateral wall, a hinged end, and a locking end;

the second lateral wall being positioned adjacent with the second base plate;

the second lateral wall being perimetrically fixed with the second base plate;

the hinged end being positioned opposite the locking end about the second lateral wall;

the first base plate being positioned adjacent with the second lateral wall, opposite the second base plate;

the second lateral wall being hingedly coupled with the first base plate; and, the lid being operatively coupled with the protective cap, wherein the locking mechanism locks and unlocks the protective cap with the lid.

3. The tumbler with maneuverable straw as claimed in claim 2 comprises:

the locking mechanism comprises a button, a spring, a lever, a first tab, and a second slot;

the button, the spring, the lever, and the first tab being positioned adjacent with the locking end, opposite the second base plate;

the button being externally mounted into the first lateral wall;

the spring, the lever, and the second slot being internally integrated into the first lateral wall;

the first tab fixed with the second lateral wall;

the first tab being oriented coplanar with the second lateral wall;

the spring being mounted within the first base plate;

the lever being positioned offset with the button;

the lever being connected with the button;

the lever being slidably engaged within the first base plate;

the lever being positioned in between the spring and the button;

a fixed end of the spring being fixed with the second base plate;

a free end of the spring being positioned adjacent with the lever;

the second slot traversing into the first base plate;

the second slot being positioned in between the lever and the button; and, the lever being operatively coupled with the first tab, wherein the button hooks and unhooks the lever with the first tab.

4. The tumbler with maneuverable straw as claimed in claim 2 comprises:

the locking mechanism further comprises a second tab and a latch;

the second tab and the latch being positioned adjacent with the locking end, opposite the second base plate;

the latch being externally positioned with the first lateral wall;

a fixed end of the latch being hingedly connected with the first lateral wall;

a free end of the latch being positioned opposite the fixed end about the latch;

the second tab being externally fixed with the second lateral wall;

the second tab being oriented perpendicular with the second lateral wall; and, the free end of the latch being engaged with the second tab.

5. The tumbler with maneuverable straw as claimed in claim 2 comprises:

the protective cap further comprises a mouthpiece-receiving gasket;

the mouthpiece-receiving gasket being mounted onto the second base plate;

the mouthpiece-receiving gasket being positioned within the second lateral wall; and, the mouthpiece being positioned adjacent with the mouthpiece-receiving gasket.

6. The tumbler with maneuverable straw as claimed in claim 2 comprises:

the protective cap further comprises a handle, a handle bed, and a notch;

a first end of the handle being positioned opposite a second end of the handle about the handle;

the handle bed being externally integrated into the second base plate;

the handle traversing across the handle bed;

the first end and the second end being hingedly connected into the handle bed;

the notch being centrally positioned along with the handle; and, the notch traversing into the handle.

7. The tumbler with maneuverable straw as claimed in claim 2 comprises:

the straw assembly comprises an inner seal and an outer seal;

the lid further comprises an outer ring, a flange, and a straw-receiving gasket;

the outer ring being fixed with the first base;

the outer ring being positioned around the first ring;

the flange being fixed with the first base, opposite both the inner ring and the outer ring;

the flange being positioned around the first slot;

the inner seal being positioned in between the cylindrical portion and the hemispherical base portion;

the inner seal being hermetically sealed around the hemispherical base portion;

the outer seal traversing from the inner seal to the outer ring;

the outer seal being hermetically sealed around both the inner seal and the outer ring;

the straw-receiving gasket being positioned adjacent with the flange;

the straw-receiving gasket being mounted around the flange; and, the straw being hermetically sealed with the straw-receiving gasket.

8. The tumbler with maneuverable straw as claimed in claim 1 comprises:

the tumbler further comprises a ledge;

the ledge being externally positioned around the lip;

the ledge being positioned adjacent with the cylindrical body;

the ledge being fixed with the lip; and, the ledge being positioned adjacent with the first lateral wall, opposite the first base plate.

9. The tumbler with maneuverable straw as claimed in claim 1 comprises:

the lid further comprises a rim and a lip-receiving gasket;

the rim being fixed with the first base plate;

the rim being positioned opposite the inner ring about the first base plate;

the rim being positioned offset the first lateral wall;

the lip-receiving gasket being positioned in between the first lateral wall and the rim; and, the lip-receiving gasket being mounted with the first base plate.

10. The tumbler with maneuverable straw as claimed in claim 1 comprises:

a friction-inducing base;

the tumbler further comprises a base-receiving groove;

the friction-inducing base comprises a third base plate and a third lateral wall;

the third lateral wall being positioned adjacent with the third base plate;

the third lateral wall being perimetrically fixed with the third base plate;

the base-receiving grove being positioned around the closed end of the tumbler;

the base-receiving groove being externally integrated into the cylindrical body; and, the third lateral wall being frictionally engaged around the base-receiving groove.

11. The tumbler with maneuverable straw as claimed in claim 10 comprises:

the third lateral wall being positioned offset with the closed end of the cylindrical body.

12. The tumbler with maneuverable straw as claimed in claim 1, wherein the closed end of the cylindrical body is curved.

* * * * *